United States Patent [19]

Terracciano

[11] Patent Number: 4,611,520

[45] Date of Patent: Sep. 16, 1986

[54] PUNCHING UNIT IN A PUNCHING AND/OR BINDING MACHINE FOR JOINING TOGETHER A PACK OF SHEETS BY A COMB BINDER

[76] Inventor: Flora Terracciano, Via Giulianova 1, 20100 Milan, Italy

[21] Appl. No.: 602,375

[22] Filed: Apr. 20, 1984

[30] Foreign Application Priority Data

Apr. 22, 1983 [IT] Italy ..... 21635/83[U]

[51] Int. Cl.[4] ..... B26D 5/10; B26F 1/04

[52] U.S. Cl. ..... 83/549; 83/571; 83/620; 83/628; 83/633; 83/635; 234/116

[58] Field of Search ..... 83/619, 620, 628, 633, 83/634, 635, 636, 640, 684, 689, 571, 573, 549; 234/111, 116

[56] References Cited

U.S. PATENT DOCUMENTS

| | | | |
|---|---|---|---|
| 1,888,746 | 11/1932 | Specht | 83/573 |
| 2,038,857 | 4/1936 | Rutter et al. | 83/620 |
| 2,558,044 | 6/1951 | Emmer | 83/571 |
| 2,908,173 | 10/1959 | Bardy | 83/620 |
| 2,957,380 | 10/1960 | Duncan et al. | 83/571 |
| 3,921,487 | 11/1975 | Otsuka et al. | 83/620 |
| 4,324,013 | 4/1982 | Wu | 83/620 |

*Primary Examiner*—Frank T. Yost
*Assistant Examiner*—Hien H. Phan
*Attorney, Agent, or Firm*—Yount & Tarolli

[57] ABSTRACT

A punching unit in a punching binding machine for joining together packs of sheets by a resilient teeth comb binder, comprises on a framework of the machine: a fixed bar provided with openings having a substantially vertical axis; a plurality of punches, each of which extended through the openings and each comprising a bottom cutting edge and a tang extended at the top of the bar; a movable bar arranged at the top of the fixed bar and carrying a series of catches, each of which movable between an active position for operating the relative punch, and a rest position where such a punch is not thereby operated; the movable bar being supported on slides sliding on the framework; a control assembly for the lowering of the movable bar on the fixed bar. The control assembly comprises: a control shaft rotatably carried on the framework; a plate integral in rotation with the shaft; a connecting rod pivoted at one end to the plate; a lever pivoted at the other end of the connecting rod, and having its fulcrum at a fixed location to the framework and extended beyond the fulcrum to form a head engaged with the slide for movement of the latter.

5 Claims, 4 Drawing Figures

PUNCHING UNIT IN A PUNCHING AND/OR BINDING MACHINE FOR JOINING TOGETHER A PACK OF SHEETS BY A COMB BINDER

BACKGROUND OF THE INVENTION

This invention relates to the field of perforating-binding or punching-binding machines, for office use, for binding packs of sheets by a comb binder generally made of plastics. Such a type of binder comprises a continuous web and resilient teeth extended tranversely of the web and normally circularly coiled on themselves. First, at a seat thereof, such machines provide for perforating aligned spaced apart holes adjacent one edge of the pack of sheets to be bound together. Then, at a second seat thereof, such machines provide for widening out and momentarily open the comb teeth of the binder, so that the pack of previously perforated sheets can be inserted therebetween, and then release such teeth which close on themselves binding the sheets.

Many of such machines are known and used at present. Generally, they comprise a punching unit and a binding unit on a single frame, generally controlled by means of a single lever. The binding unit comprises two series of finger elements. The elements in the first series are straight and perform the function of holding or retaining the binder web, and the elements in the second series are generally of angled shape or in any case have a portion extended transversely of said first mentioned elements to grip the curl of each resilient tooth of the binder. A relative movement between the two series of finger elements is preset in various known manners.

Generally, the punching unit comprises a series of aligned moving punches, carried by resilient means on a bar fixed to the machine structure or framework, and a movable bar carrying aligned latches, each of which at a position corresponding to a punch, for operating the relative punch upon lowering of the movable bar on the fixed bar. The punches have a lower cutting end cooperating with an opening or die. Generally, the cutting edge of the punch has a single inclination on one side and the opposite side of the punch. Moreover, in order to reduce the strain to be exerted for perforation, the punches are generally of a different length from one another, so that the latches upon lowering of the movable bar would not come simultaneously in contact with all of the punches. Various types of driving units are provided for operation of the punching unit and binding unit. A type of machine widely used at present comprises a rack drive unit.

SUMMARY OF THE INVENTION

It is a constant trend of the above mentioned machines to reduce the strain required for perforation of the sheet block.

Another object to be achieved is to obtain a releasable assembly in order to minimize the difficulty and time loss in maintenance operations.

The above mentioned objects have been achieved by providing a punching unit for a punching and/or binding machine for binding sheet packs, according to the preamble of claim 1, which punching unit comprises a shaft rotatably carried on the machine framework; a plate integral with the shaft; in the case, a stake integral with the plate for driving a drive or control arm in the binding unit; a connecting rod pivoted to one end of the plate; a lever pivoted to the other end of the connecting rod an having its fulcrum at a fixed location and extended beyond the fulcrum to form a head engaged with a slide integral with the movable bar.

According to further novel characteristics, each punch further comprises a cutting edge with a dual inclination, that is inclined according to an angle $\alpha$ along one direction and according to an angle $\beta$ along a second direction substantially orthogonal to the former direction.

A still further characteristic is that the latches have a tapered or chamfered end facing the relative punch.

Moreover, the novel unit has a self-contained frame, on which a frame of the binding unit can be mounted, said self-contained frame having a flat intermediate portion, vertical walls integral with the intermediate portion, each provided with a vertical bend forming front vertical tab.

The novel unit may be independently used or mounted to form a perforating-binding unit; it enables to perforate sheet packs with minimum strain; it enables to obtain holes with clear precise edges; and is also easy to assemble and disassemble for purposes of maintenance, replacement and allows a reduction in production costs.

An exemplary embodiment of the invention will now be described with reference to the accompanying drawings, in which:

DESCRIPTION OF THE PREFERRED EMBODIMENT

Figure 1:
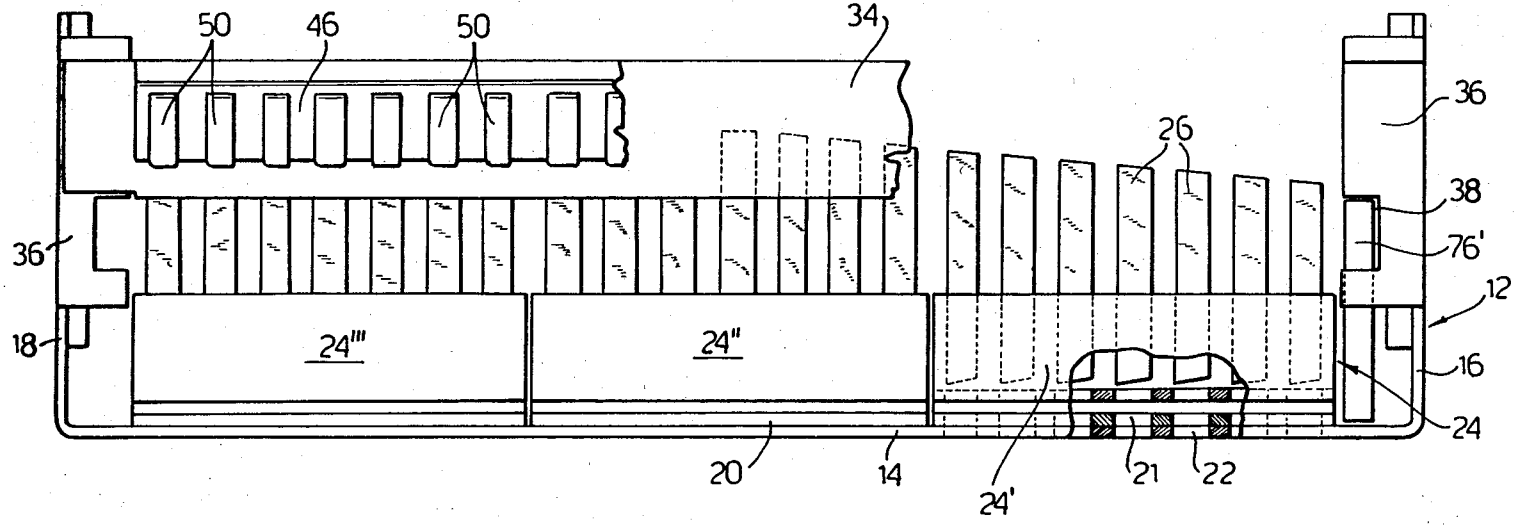
FIG. 1 is a front view of the unit with parts being removed.

The terms "horizontal", "vertical" and the like as herein used refer to the embodiment shown and should not be intended in a limiting sense.

A punching unit 10 for a perforating and/or binding machine comprises a casing or frame 12 made as a self-contained unit. Said frame 12 comprises a base portion 14 and vertical walls 16, 18 so as to be of substantially U-shape when seen in front view. Each of the vertical walls 16 or 18 have a curved or bent vertical edge to form a vertical slide guide 16' and 18', respectively. The base portion 14 may be applied as desired on any type of the machine bed (not shown), and carries matrix plates 20. As usual, through holes 21 and 22, respectively, are drilled through said plates 20 and portion 14 for cooperation with the punches, as explained in the following.

Figure 2:
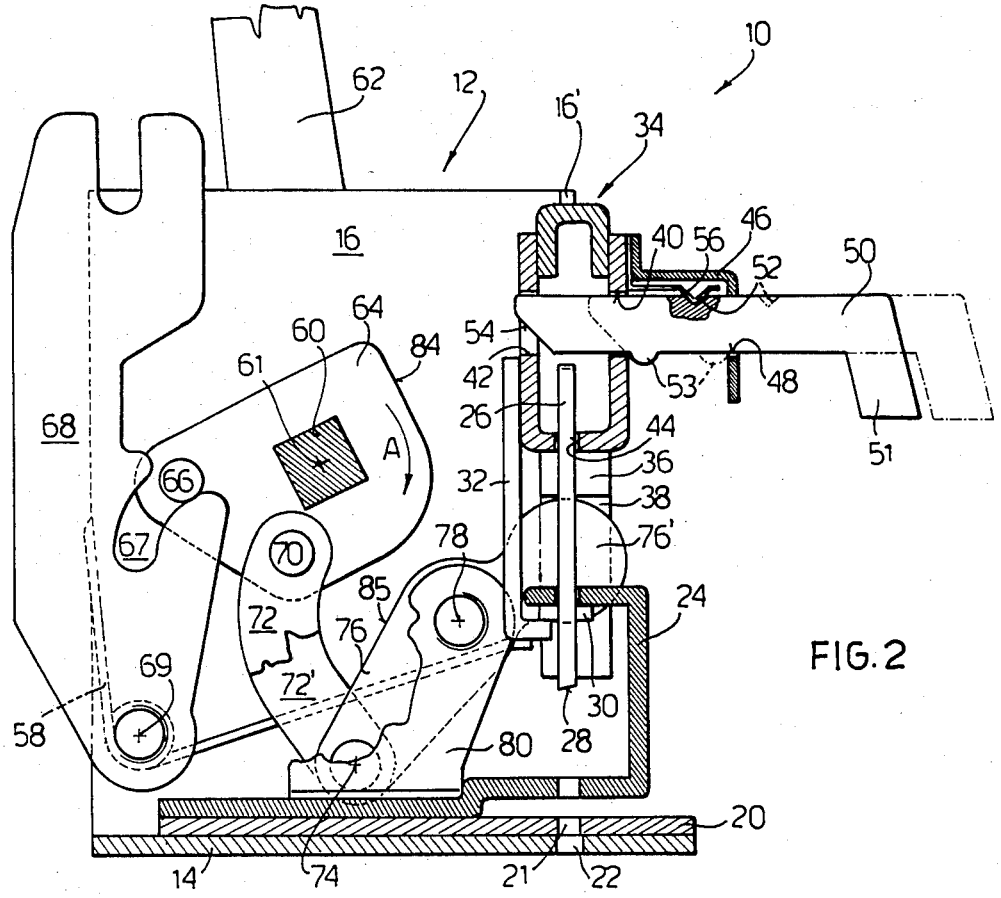
FIG. 2 is a vertical sectional view through the unit, such as according to line 2—2 of FIG. 1.

Said plates 20 have mounted thereon a fixed punch-holder bar 24, preferably made of bent blank sheet (FIG. 2) and made in a plurality of adjacent sections, such as 24', 24'', 24''' (FIG. 1).

Figure 3:
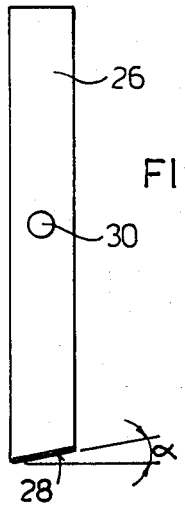
FIGS. 3 and 4 are respectively a front view and a side view of a punch.
Figure 4:
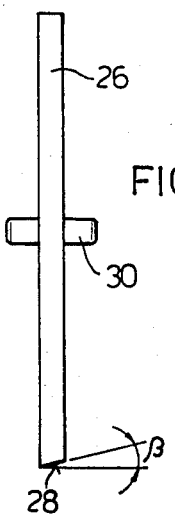

Said bar 24 is substantially of C-shape, the upper and lower legs of which are perforated at vertically corresponding locations, and a punch 26 is slidably received in each pair of holes. Each punch 26 comprises (FIGS. 3 and 4) a flat metal bar of rectangular section, at the lower end provided with cutting edge 28. Each of said punches 26 have a transverse stake 30, and each of said stakes 30 are supported by an element 32 integral with a movable upper bar 34 to be explained in the following. In the absence of external forces, the punch is arranged with the cutting edge generally retracted within said bar 24 and with the upper tang portion extended at the top of bar 24. As well known, the lengths of the punch are different from one another for a gradual operation of the punch assembly.

According to this application, the punch cutting edge 28 has a dual inclination (FIGS. 3 AND 4), that is a first inclination $\alpha$ along the major side of the rectangle forming the punch section, and this inclination is $\alpha$=about 10°, and an inclination $\beta$ along the minor side of the rectangle, and this inclination is $\beta$=about 5°. The dual inclination of the cutting edge allows a more gradual ingress of the punch in the sheet pack and a less strain to be applied for punching.

At the top of fixed bar 24, said frame 12 carries a movable bar 34. This bar is integral with side slides or shoes 36, preferably made of nylon or antifriction plastics material, which shoes are slidably engaged on the vertical edges or guides 16' and 18' of the side walls of frame 12. Each of said shoes 36 have a slot 38 as a seat for a head of a control element, as explained hereinafter.

Said bar 34 is generally made of bent blank sheet and has pairs of aligned openings 40, 42 of horizontal axis, and a bottom opening 44 at each pair of openings 40, 42. Each said pair of openings 40, 42 has the axis lying in a vertical plane containing the axis of a punch. A bracket 46 is fixed to said bar 34 at the front thereof and extends throughout the length of bar 34. This bracket 46 has through holes 48 aligned with the pairs of holes 40, 42. Each series of holes 40, 42, 48 has a latch 50 arranged therethrough, which generally comprises a small bar of blank metal sheet. Said latch 50 has a nib or prong 51 at the outer end for easiness in gripping thereof; an upper notch 52; a lower ridge 53; and a tapered inner end 54. Between said bracket 46 and bar 34 there is interposed a return spring 56 having an angled portion. Said latch 50 is movable between an inserted position (shown by continuous line) and a disconnected position (shown by dashed line). At the inserted position, said spring 56 engages said slot 52. The snap caused by this engagement, gives to the operator the physical feeling that the latch is at correct position. Upon lowering of bar 34, each inserted latch operates the underlying punch.

At disconnected position, said ridge 53 is against said bracket 46 to prevent the latch from being completely extracted. Each disconnected latch upon lowering of bar 34 does not operate the underlying punch. The tapered end 54 allows that the latch, should it be placed at intermediate position between inserted and disconnected positions to be ejected from the relative punch upon lowering of bar 34, thus avoiding any deformation in the latch as sometimes occurs in conventional machines. A spring means 58 between the frame and movable bar urges the movable bar and hence the element 32 and punches to raised position.

A control mechanism of the machine (FIG. 2) is arranged against the vertical wall 16, and comprises a control shaft 60 of square section carried within said wall 16 rotatably about an axis 61, and a control lever 62 (only partially shown) integral with said square shaft and extended externally of the frame. Internally of the frame and on said square shaft 60, a plate 64 is carried and integral in rotation with said shaft, but longitudinally movable thereon to allow the best automatic position adjustment. A stake 66 is fixed on the plate 64 at radially spaced apart position from axis 61. The stake 66 engages a slot 67 of a control arm 68 of the machine binding unit (not shown). Such an arm is pivoted at 69 to the frame, and will not be herein further explained because of being per se well known.

Said plate 64 also carries a fulcrum 70 for one end of a pair of small connecting rods 72, 72' (the latter shown broken away for the sake of clarity), the other ends of which are rotatably connected at pivot 74 to an end of a lever 76. At intermediate position, this lever 76 is pivoted at 78 to a support 80 fixed to the machine frame. The connecting rods 72 and 72' and lever 76 slide with the plate 64 upon sliding thereof. The amount of the sliding movement may be limited by any conventional means. Said lever 76 extends beyond said fulcrum 78 and forms a head 76' engaged within the opening 38 in a shoe or slide 36. Thus, said lever 76 forms a first class lever which is advantageous since the distance between 74 and 78 is larger with respect to the distance between 78 and the force application location between said head 76' and slide 36.

The unit may also comprise per se known margining means (not shown).

On plate 64 a surface 84 is of such an arrangement and shape as to engage with a surface 85 of lever 76 at a position of end of stroke (end of punch lowering) so as to form a stop, without any need of applying to the machine additional stop means. Said square shaft 60 extends from said vertical wall 16 to wall 18 and is supported on both said walls. Generally, at said wall 18 there is provided an assembly (not shown) comprising corresponding elements 64, 68, 72 and 76 as described in connection with wall 16.

The rotation of shaft 60, caused by the operator through lever 62 in the direction of arrow A, causes the clockwise rotation (FIG. 2) of head 76' and hence lowering of the slides, movable bar and punches. The movement caused by said spring 58 causes the raising of the punches, movable bar, and counterclockwise rotation of said head 76, plate 64 and lever 62.

What I claim is:

1. A punching unit for use in a punching or perforating binding machine for binding a pack of sheets, said punching unit comprising:

a bar fixedly mounted on a framework of the machine and having a plurality of substantially vertical openings, a plurality of punches extending through said plurality of openings and having bottom cutting edges and tangs projecting above the top of said fixed bar, a movable bar mounted above said fixed bar and movable relative to said fixed bar between an operating position in which said punches engage the pack of sheets and a nonoperating position in which said punches are spaced from the pack of sheet, a plurality of latches carried by said movable bar and movable between a first position in which they operate respective punches and a second position in which the respective punches are not operated by said plurality of latches, and control means for effecting movement of said movable bar, said control means including a control shaft rotatably supported on the framework of the machine, a plate mounted on shaft for joint rotation therewith, a pivotable lever for moving said movable bar upon rotation of said plate, and connecting means for connecting said pivotable lever to said plate and having one end attached to said plate and the other end attached to said pivotable lever for pivoting the same upon rotation of said plate to thereby effect movement of said movable bar, said movable bar having slide means fixedly attached thereto for supporting said movable bar for movement on the framework of the machine, and said pivotable lever having its fulcrum at a fixed location on the framework of the machine and having a head portion extending beyond the fulcrum and engaging said slide means for moving said slide means and said movable bar upon pivotal movement of said pivotable lever.

2. A unit as claimed in claim 1, wherein each said punch comprises a cutting edge cut with a dual inclination, that is inclined according to an angle $\alpha$ along one direction and according to an angle $\beta$ along a second direction tranversely of the first direction.

3. A unit as claimed in claim 2, wherein said angle $\alpha$ is about 10° and said angle $\beta$ is about 5°.

4. A punching unit in a punching or perforating-binding machine for binding packs of sheets with resilient teeth comb binder, said punching unit comprising on a framework of the machine, a fixed bar provided with substantially vertical openings, a plurality of punches extending through said openings and each comprising a bottom cutting edge and a tang extended at the top of said bar, a movable bar arranged at the top of said fixed bar and carrying a series of latches each of which is movable between an active position in which a respective punch is operated thereby and a rest position in which said respective punch is not thereby operated, said movable bar being supported on slides sliding on the framework, a control assembly for lowering of the movable bar on the fixed bar, said control assembly comprising a control shaft rotatably carried on the framework, a plate integral in rotation with the shaft, a connecting rod attached to the plate at one end thereof and to a lever pivotal at the other end thereof, said lever having its fulcrum at a fixed location on the framework and extending beyond the fulcrum to form a head engaging at least one of said slide, said plate and said lever having cooperating surfaces engaging each other at the end of a stroke to thereby form a stop.

5. A punching unit in a punching or perforating-binding machine for binding packs of sheets with resilient teeth comb binder, said punching unit comprising on a framework of the machine, a fixed bar provided with substantially vertical openings, a plurality of punches extending through said openings and each comprising a bottom cutting edge and a tang extended at the top of said bar, a movable bar arranged at the top of said fixed bar and carrying a series of latches each of which is movable between an active position in which a respective punch is operated thereby and a rest position in which said respective punch is not thereby operated, said movable bar being supported on slides sliding on the framework, a control assembly for lowering of the movable bar on the fixed bar, said control assembly comprising a control shaft rotatably carried on the framework, a plate integral in rotation with the shaft, a connecting rod attached to the plate at one end thereof and to a lever pivotal at the other end thereof, said lever having its fulcrum at a fixed location on the framework and extending beyond the fulcrum to form a head engaging at least one of said slide, said plate being movable along said shaft.

* * * * *